US005743551A

United States Patent [19]

Goud et al.

[11] Patent Number: 5,743,551

[45] Date of Patent: Apr. 28, 1998

[54] RETENTION ELEMENT FOR A BOOT ON A GLIDING BOARD

[75] Inventors: Gilles Renaud Goud, Annecy; Pierre Vuillermet, Annecy le Vieux; Philippe Schary, Cruseilles, all of France

[73] Assignee: Salomon S.A., Metz-Tessy, France

[21] Appl. No.: 524,026

[22] Filed: Sep. 6, 1995

[51] Int. Cl.[6] ..... A63C 9/08

[52] U.S. Cl. ..... 280/634; 280/636

[58] Field of Search ..... 280/607, 626, 280/629, 630, 633, 634, 636

[56] References Cited

U.S. PATENT DOCUMENTS

| | | | |
|---|---|---|---|
| 4,538,828 | 9/1985 | Dimier | 280/628 |
| 4,561,673 | 12/1985 | Pascal et al. | 280/629 |
| 4,984,816 | 1/1991 | Rullier | 280/636 X |
| 5,016,902 | 5/1991 | Goud et al. | 280/630 |
| 5,040,821 | 8/1991 | Berthet et al. | 280/636 X |
| 5,044,658 | 9/1991 | Challande et al. | 280/636 X |
| 5,303,950 | 4/1994 | Rigal et al. | 280/636 |
| 5,449,192 | 9/1995 | Challande et al. | 280/636 |
| 5,560,634 | 10/1996 | Challande et al. | 280/636 X |

FOREIGN PATENT DOCUMENTS

| | | |
|---|---|---|
| 2458299 | 1/1981 | France . |
| 2640882 | 6/1990 | France . |
| 2905837 | 8/1980 | Germany . |
| 3307022 | 9/1983 | Germany . |
| 3343545 | 6/1984 | Germany . |
| WO91/08808 | 6/1991 | WIPO . |

*Primary Examiner*—Brian L. Johnson
*Assistant Examiner*—Michael Mar
*Attorney, Agent, or Firm*—Greenblum & Bernstein, P.L.C.

[57] ABSTRACT

The invention relates to a retention element for retaining a boot on a ski, including a retention jaw, the jaw being carried by a body, including furthermore a compensation mechanism piloted by an activation element and adapted to lower the return force developed by the spring on the jaw in response to the downward support force exerted by a support plate whose movable support zone rests on the activation element of the compensation mechanism. The support plate has on both sides of the support zone with the activation element two carrying zones from bottom to top of the plate against the plate, which define with at least one carrying zone positioned on the rear of the plate two preferred rocking lines of the plate relative to the plate around which the support plate can rock under the effect of the variations of the support force of the boot.

14 Claims, 4 Drawing Sheets

RETENTION ELEMENT FOR A BOOT ON A GLIDING BOARD

BACKGROUND OF THE INVENTION

1. Field of the Invention

The present invention relates to a retention element for retaining a boot on a gliding board, and particularly a retention element for a ski boot on a ski.

2. Background Information and State of the Art

Generally, a ski boot is retained on the ski by a front retention element and a rear retention element, which are responsible for freeing the boot if excessive biases exist at the linkage between the boot and the ski.

In a know manner, each retention element has a jaw carried by a body connected to the ski. The jaw is movable against the elastic return force generally exerted by a return spring seated in the body. For the front retention element, the jaw is generally movable with respect to the body, or the body is movable with respect to a base affixed to the ski.

Furthermore, the boot rests on front and rear support plates which are in principle associated with the front and rear retention elements.

Certain front retention elements are furthermore equipped with a compensation mechanism, which is adapted to lower the return force that the spring exerts on the jaw in the case of certain fall configurations. For example, in the case of a "front-torsional" fall, such a mechanism compensates for the increase in friction between the boot and the ski, which delays release of the boot.

Thus, published German Patent Application Nos. DE 29 05 837 and DE 33 43 545, or 33 07 022, describe a mechanism activate by the support plate of the boot, which acts on the return spring of the jaw, or on the jaw itself.

Such mechanisms give good results, but given that the support plate cannot be displaced except along a vertical direction, they only take into account the vertical component exerted by the boot relative to the ski. Yet, it happens that in the case of certain complex falls the friction between the boot and the ski is elevated, but the vertical component exerted by the boot on the support plate is not sufficient to effectively activate the compensation mechanism. Such a situation occurs, for example, in the case of a front-torsional fall with twisting of the boot in the jaw of the retention element.

SUMMARY OF THE INVENTION

One of the objects of the invention is to improve the compensation mechanism of a retention element, in particular, a front retention element.

Another object of the invention is to propose a retention element equipped with such an improved compensation mechanism which is simple to construct.

These objects and other objects of the invention will appear in the course of the description which follows, and are achieved by the retention element according to the invention. This element comprises a retention jaw adapted to maintain an end of the boot supported against the board, the jaw being carried by a body adapted to be assembled to the gliding board. The jaw is furthermore movable under the effect of forces exerted by the boot against the return force of a spring seated in the body. The element further comprises a compensation mechanism piloted by an activation element and adapted to lower the return force developed by the spring on the jaw in response to the downward support force exerted by a support plate of which one movable support zone rests on the activation element of the compensation mechanism, along a vertical downward direction, the support plate being movable with respect to a plate adapted to be affixed to the ski.

The support plate of the retention element according to the invention has on both sides of the support zone with the activation element carrying zones from the bottom to the top of the plate against the other plate, which define with at least one carrying zone situated on the rear of the plate, two overriding rocking lines of the plate relative to the plate around which the support plate can rock under the effect of variations of support force of the boot.

The act of rendering the support plate of the boot movable by rocking around one or the other of two rocking lines generally oriented along the longitudinal direction of the plate renders the support plate movable both in transverse rocking, which corresponds to a rolling movement of the boot above the ski, and in a vertical direction downwardly. This makes it possible to activate the compensation mechanism in the case of a complex fall where the boot exerts on the retention element a bias with a rolling component, and/or with a vertical component.

BRIEF DESCRIPTION OF THE DRAWINGS

The invention will be better understood with reference to the description below and the annexed drawings which are an integral portion thereof, in which.

DETAILED DESCRIPTION OF THE PREFERRED EMBODIMENTS

Figure 1:
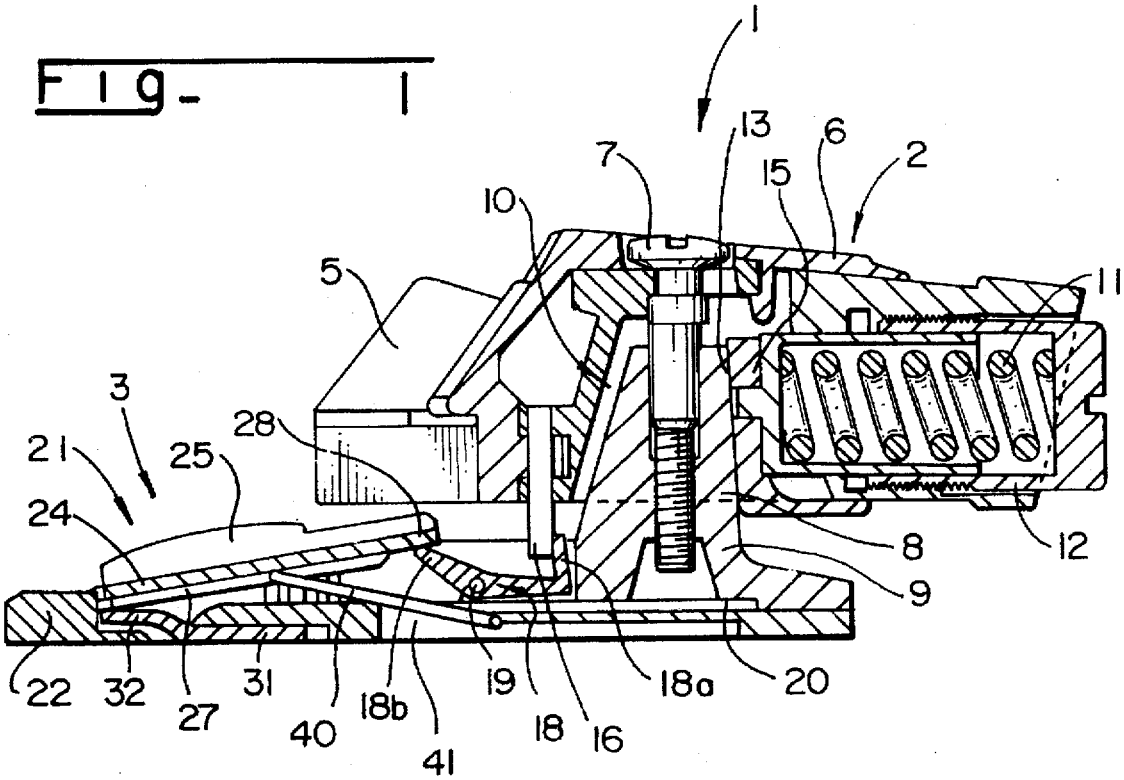
FIG. 1 is a general view in longitudinal cross section of a front retention element according to a first non-limiting mode of performing the invention.

FIG. 1 shows in side view a retention element 1 adapted to retain in a releasable manner the front end of a boot.

Element 1 shown in FIG. 1 comprises a retention structure 2 of the boot and a support structure 3 on which the sole of the boot rests. The retention structure is known in large measure from published French Patent Application No. 2 458 299, in particular the embodiment of FIG. 10, the disclosure of which is hereby incorporated by reference thereto.

It comprises a retention jaw 5 of the boot. The jaw is carried by a body 6 with which it forms a monolithic assembly. The jaw can have adjustment means to adapt it to the shape of the tip of the boot, furthermore, preferably, the body has an adjustment screw 7 to adapt to the thickness of the sole of the boot. These means are known and are not per se a part of the invention. They will not be described in detail. The body is pivotally mounted around pivot 8 adapted to be affixed to the ski by means of a base 9 positioned at its lower portion. The base and the pivot are of a known type and are more particularly visible in FIG. 2. Particularly, the base as seen from the top has a "U" shape, with to arms 9a and 9b which extend towards the rear.

According to what is known from French Patent Application 2 458 299 described above, the body is supported against the pivot by two support lines positioned at the rear surface 10 of the pivot. The support lines are converging, and they are formed by two lower support zones 10a and 10b positioned at the base of the pivot on each side of the median plane of symmetry of the pivot, and an upper support zone common to the two lines, which is positioned at the level of the head of the adjustment screw 7 which adjusts the height of the body.

Thus, the jaw can pivot around one or the other of these two support lines along a slightly ascending pivoting movement.

The jaw and the body are returned to the centered position on the ski by a spring 11 positioned in the body whose on end is retained by a threaded stopper 12 which is screwed into the front portion of the body, and whose other end is supported against a substantially planar surface 13 position at the front surface of the pivot, by means of an intermediary piston 15.

The operation of this retention structure is known in particular from the above referenced patent.

The retention element furthermore comprises a compensation mechanism adapted to lower the force that the boot must transmit to the jaw to be released.

For the elements shown, the compensation mechanism comprises a shaft 16 embedded in the lower portion of the jaw slightly at the rear of the pivot, along an approximately vertical direction. The shaft is positioned between the two support zones. The lower end of the shaft 16 projects under the jaw, and it is positioned between the two support zones 10a 10b. This end of the shaft offers a grip to the approximately vertical arm 18a of a return 18 journeyed around a pin 19 oriented along a transversal direction. The pin 19 is for example carried by a foil 20 applied to the lower surface of base 9.

The return 18 presents an inclined arm 18b towards the rear 18b by which it is biased in rotation, which causes a movement from front to rear of the arm 18a.

This movement is transmitted to the jaw 5 by means of the shaft 16, which taking into account its position, creates an additional rotational moment of the body around one or the other of its two support lines which facilitates its rotation. Thus, the shaft constitutes a connection between the activation element 18 and the jaw 5.

The release of the boot is therefore facilitated by a vertical force exerted on the arm 18b of the return 18.

It is appropriate to note here that the retention structure 2 which has been described is not limiting for the invention, and that any other appropriate structure may be used on a condition that it has a compensation mechanism of the type which has been described, with an activation element of this mechanism, an element which is here constituted in a non-limiting manner by the return 18. Such structures are described and the patent applications published under numbers FR 2 640 882 or DE 29 05 837.

The retention element shown in FIG. 1 furthermore has a support structure 3 which is adapted to support the front of the boot. Furthermore, this support structure comprises a moveable support plate which is adapted to activate the return 18.

Thus, the support structure 3 has a support plate 21 on which the boot rests, and a plate, or base plate 22 which carries the support plate 21 and which is adapted to be solidly affixed to the ski.

In the embodiment illustrated, the support plate is in two part, a pedal 24, which is capped by a lining 25. In particular, the lining has a small plate of anti-friction material 26, which is adapted to facilitate the lateral sliding of the boot. The lining 25 is for example formed of plastic material, and it is assembled to the pedal 24 by any appropriate means.

The pedal 24 itself is relatively ridged, it is formed for example out of a reinforced sheet metal reinforced by a longitudinal rib 27. If desired, it can have other reinforcement ribs.

On the front, pedal 24 has a narrower tongue 28 which forms the support zone with 18b of the rocker or more generally with the activation element of the compensation mechanism.

Plate 22 extends under pedal 24, and it extends frontwardly under base 9 of pivot 8.

The base plate 22 has at its upper surface in a preferred manner an opening 30 where support plate 21 and base 9 are seated.

Furthermore, in a preferred manner, likewise, plate 22 has in its rear portion a reinforcement counterplate 31 which is adapted to extend globally under the plate, and to extend through small plate 22 on both sides on the front and rear. This counterplate assures the linkage between the support plate 21 and the plate 22.

The reinforcement counterplate has on the rear a horizontal ear 32 which opens into opening 30. Ear 32 rests on a shoulder of the plate 22, and it furnishes a support for the rear portion of pedal 24 along a vertical downward direction. Preferably, it is the rear portion of the reinforcement rib 27 which is adapted to contact ear 32, which gives a semi-point carrying zone of the pedal on the plate. Naturally, in another appropriate means may be used, and in particular, a detachable rivet head, or a particular shape obtained by deformation of the pedal or further a rib on the ear 32 of reinforcement 31 supported on pedal 24 which will be planar.

Preferably, the rear portion of the pedal is nested in the plate to retain the rear of the pedal towards the top and along a lateral direction, without disturbing its movement.

For example, as it is shown in the Figures, the pedal has on the rear a cut-out having a "U" shape 29 which is engaged in a slot of the plate 22 so as to form a lateral nesting. Furthermore, the cut-out has a small tab 29a which is engaged in the opening of the slot to form a vertical retention towards the top of the pedal. The opening has greater dimensions than those of the tab. Naturally, any other appropriate means may be used.

Towards the front, the counterplate 31 has two ears 34 and 35, which extend along an approximately vertical direction of the length of the contour of the pedal 24, on both sides of the tongue 28. The ears 34 and 35 are cut away in their central portion, and a tab extends there through, respectively at 36 and 37, of the pedal 24 which projects with respect to the general contour of the plate. The assembly is adapted such that the tabs 36 and 37 describe openings 38 and 39 of ears 34 and 35 in the course of the movement of pedal 24. Towards the top, the openings 38 and 39 furnish to the tabs 36 and 37 two carrying zones against which they are supported when pedal 24 is in an upper rest position.

Ears 32, 34 and 35 of the counterplate 31 extend through openings of the plate 22. Preferably, the openings of the plate are generously sized along a longitudinal direction. Thus, during mounting, the counterplate is inserted in the plate, and has a substantial play along a longitudinal direction. This makes it possible to place the support plate 21 on the plate, and in particular to engage the tabs in the ears 34 and 35. Then, base 9 of the retention element is assembled to the plate. The assembly openings are adapted so that base 9 pushes and maintains the counterplate towards the rear where it retains the tabs engaged in the openings of the ears. This forms a simple assembly of the support plate to the plate, by means of the counterplate.

Figure 4:
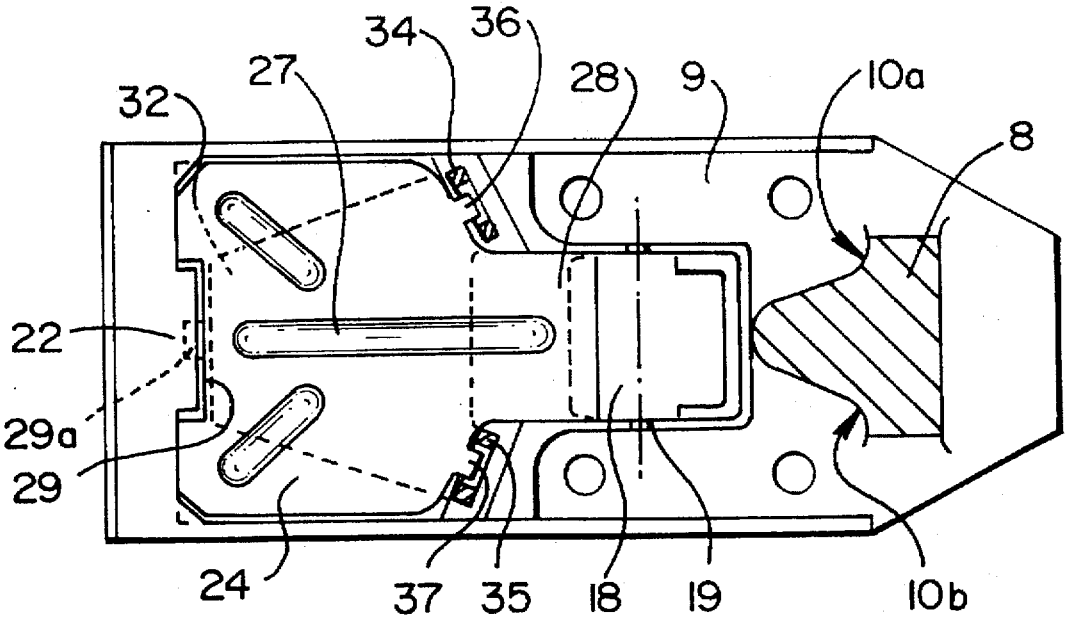
FIG. 4 is a top view of the support plate.
Figure 5:
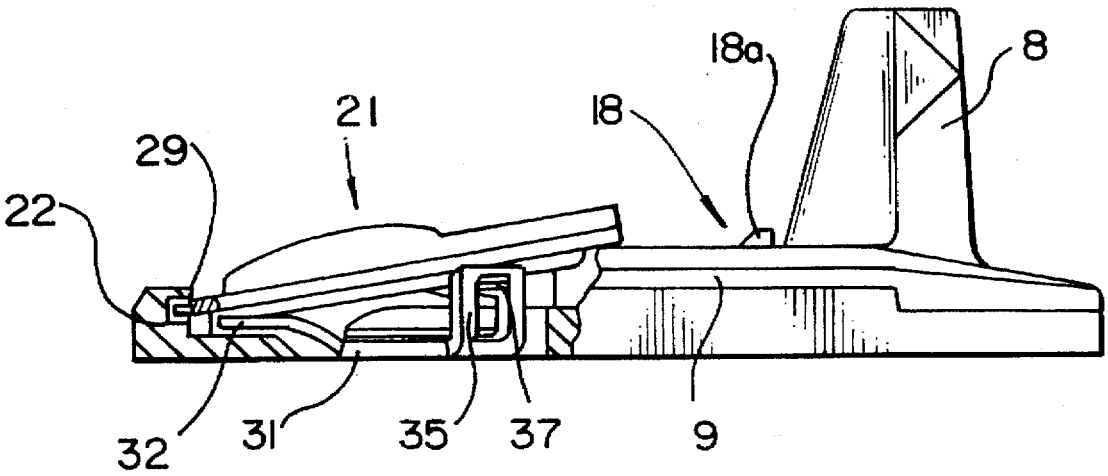
FIG. 5 shows the support plate of FIG. 3 seen in longitudinal cross section through different longitudinal planes.
Figure 6:
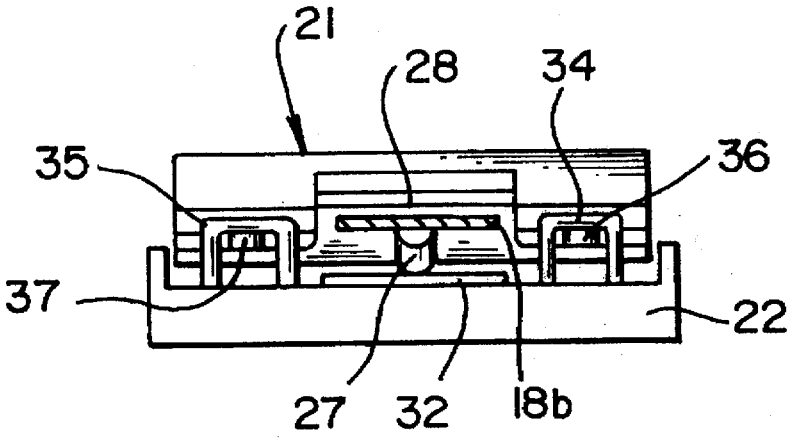
FIGS. 6–8 represent the support plate of FIG. 4 seen in transverse cross section and illustrate its manner of operation.

In the rest position illustrated in FIGS. 4–6, pedal 24 rests on the plate on the rear through its rib 27. On the front, the pedal rests through its tongue 28 on arm **18*b* of the return 18, which maintains the pedal 24 in the upper position with the tabs 36 and 37 supported against the upper ends of openings 38 and 39. Thus, in the rest position, there exists a take-up of the elastic play between the pedal 24 and the reinforcement 31 on the one hand, the pedal 24 and the return 18** on the other hand.

The pedal 24 is thus positioned to be supported towards the bottom at its rear portion with its rib 27, in its front portion with the tongue 28 against the arm **18*b* of the return 18, which can lower itself in the case of strong bias. Furthermore, the front portion of the pedal is lifted by the return against the two ears 34 and 35**.

The return 18 exerts on the tongue 28 of the pedal a constraint towards the top, sufficient such that the pedal does not lower under the affect of the weight of the skier alone, but only in the case of a strong increase of the support force of the boot on the support plate, which occurs in particular when the skier is in a frontward fall. In this case, the support plate 21 rests sufficiently on the return 18 to make it rock, which activates the compensation mechanism.

Preferably, to take up all of the play at rest, in the absence of the boot, an elastic means of low energy exerts on the pedal an upwardly return force. In the embodiment shown, this means is a needle spring 40 whose base extends through an opening 41 of the plate 22. The arms of spring 40 rest under support plate 2, more precisely under pedal 24. The elasticity of spring 40 is utilized both to form the elastic return of the pedal 24 and the maintenance of the base of the spring in the plate.

Figure 7:
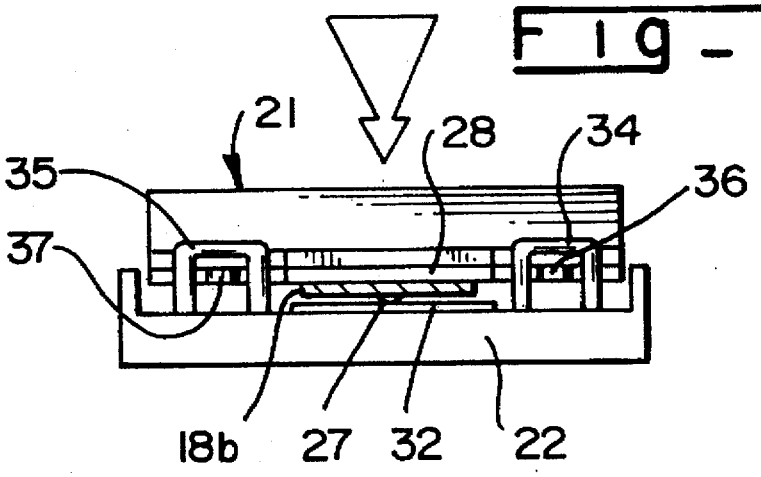

FIG. 7 illustrates the movement of the support plate 21 in the case of a purely frontward fall. In this case, this support plate lowers, at least small tongue 28, which causes a rocking of the return 18. The two tabs 36 and 37 describe the openings of ears 34 and 35.

Figure 8:
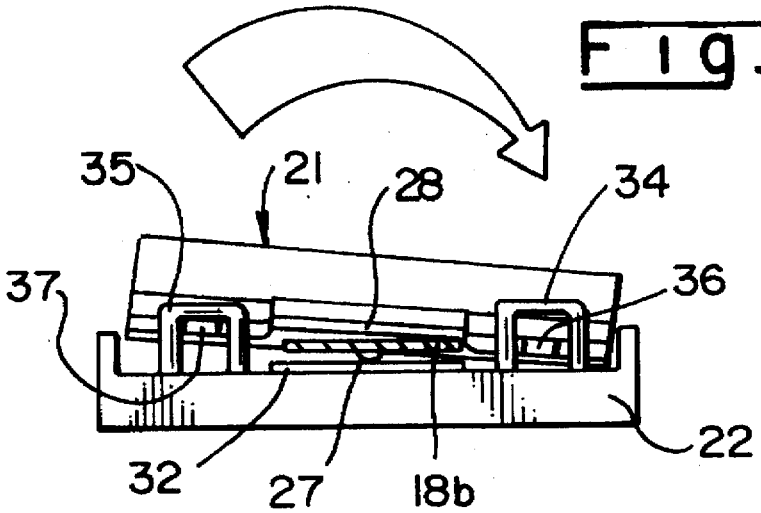

FIG. 8 illustrates the movement of the support plate 21 in the case where the boot biases the retention element along a twisting bias, i.e., along a rolling movement. In this case, the support plate is supported on the rear of the rib 27 and on ear 34 or 35 (35 in the case of FIG. 8), to rock around this rocking line thus formed.

In the course of this rocking movement, small tongue 28 exerts a force downwardly on arm **8*b* and causes the rotation of return 18 if the force is sufficient. The rocking movement occurs against the return force that return 18** develops by reaction.

It should be noted in this case, that the intensity of the force is transmitted, and the amplitude of the rocking movement of the return depends on the width of the contact zone between the return 18 and small tongue 28.

As soon as the bias ceases, return 18 returns pedal 24 into its rest position, where the two tabs 36 and 37 are carried upwardly against ears 34 and 35.

Support plate 21 is movable around its rear carrying zone formed by the rear end of rib 27, along a rocking movement around one or the other of the two preferred rocking lines formed by this rear end of the rib and one of the tabs 36 and 37 supported at the top against the openings of ears 34 and 35. The support plate is also movable along any intermediate rocking movement, and in particular along the movement which has been described relative to FIG. 7. In its different movements, the plate rests on the rear end of its rib and on the arm **18*b* of the return. In the two preferred movements, the plate is supported against one or the other of the ear 34 or 35**.

Thus, the support plate 21 reacts not only in a frontward fall of the skier, but also to a fall where the boot has a tendency to twist in its retention element. It is thought that it is possible in this manner to facilitate the release of the boot.

Figure 2:
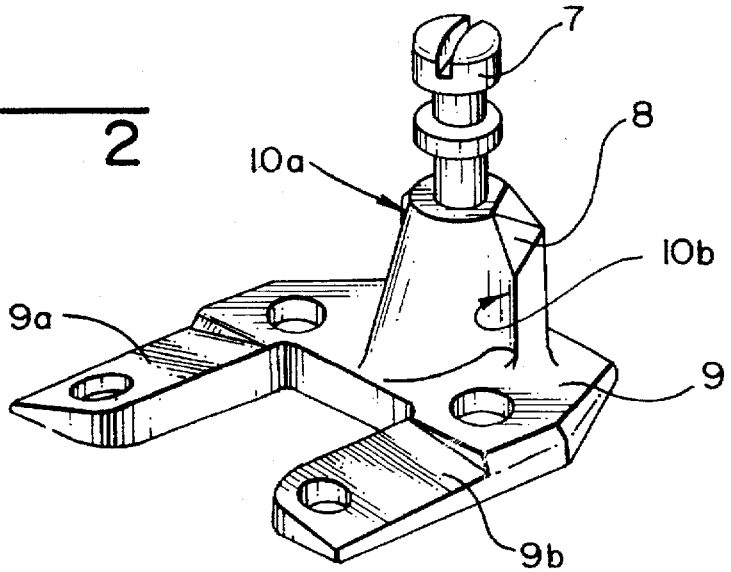
FIG. 2 is a perspective view of the pivot and its base.
Figure 3:
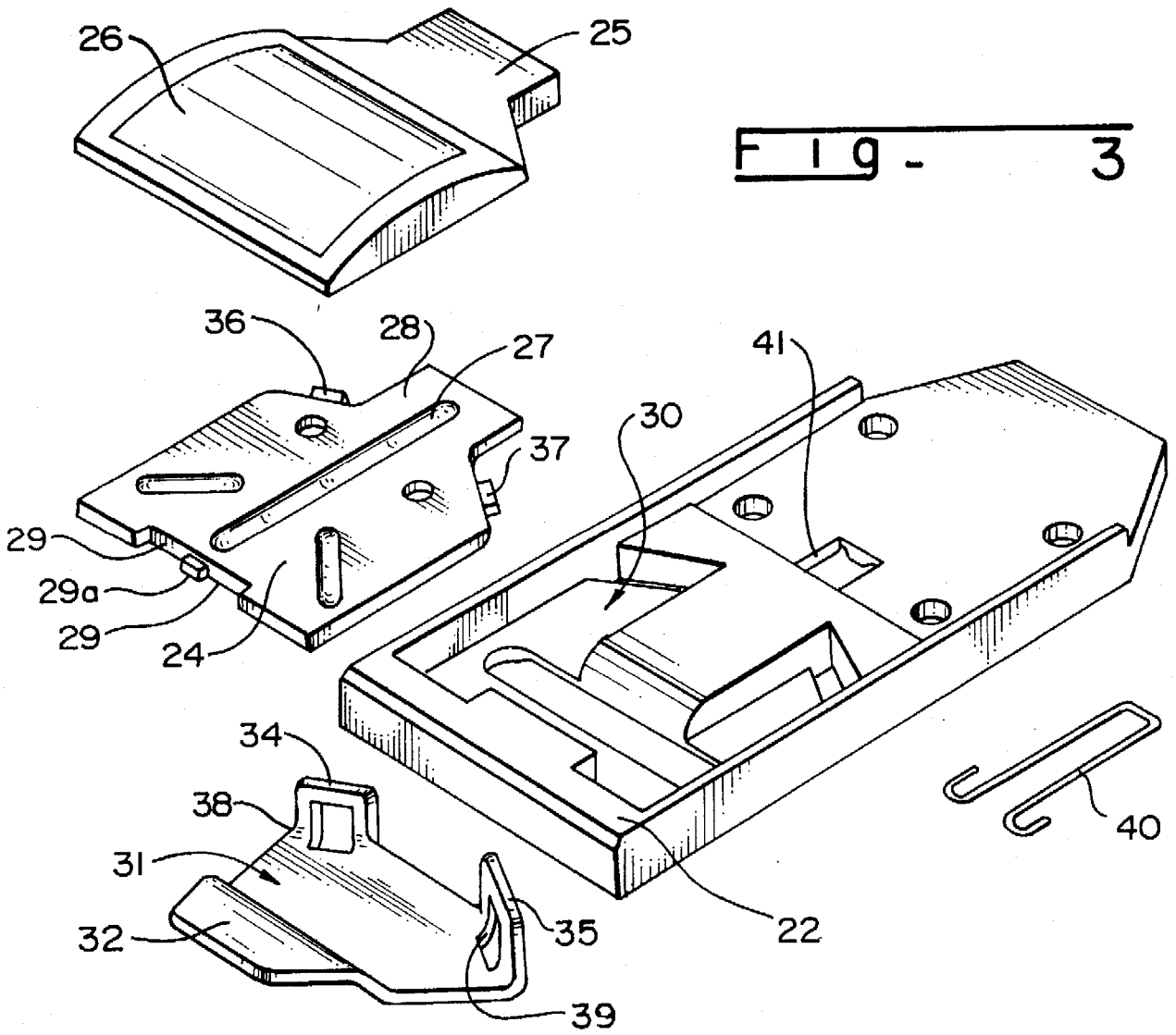
FIG. 3 is a view in exploded perspective of the different elements of the support plate of FIG. 1.

According to a preferred embodiment, the base of the retention element is disengaged on its two lateral sides, so as not to disturb the movement of the boot when the support plate 21 has laterally rocked. Thus, such as shown in FIG. 2, the two arms **9*a* and 9*b*** of the base have an upper bevelled surface, in a manner so as to reduce their thickness towards the exterior.

Naturally, the present description is not limiting, and variations are possible.

Thus, ears 34 and 35 can be associated with arms **9*a* and 9*b* of the base and the pedal 24 can be supported in its rear portion directly on the plate 22. The reinforcement 31** can be, in this case, eliminated.

Reinforcement 31 such as it has been described, with a central portion under the plate, of the ears 34 and 35 which extend through the plate and a rear ear 32 resting on a shoulder, is however, preferred. In effect, the forces that the pedal exert on the ears 34 and 35 are directed upwardly. These forces can reach a very high intensity in the case of a fall with twisting of the boot, such as has been described with reference to FIG. 8.

If such forces are transmitted directly to the plate or to the base, they are taken up by the attachment screw of the base to the ski, which may cause the screw to be pulled off, in particular with a ski having a soft core.

In addition to the vertical upward forces at the level of ears 34 and 35, reinforcement 31 is also subjected to a vertical support towards the bottom of the rear of the pedal on the ear 32.

In this case, it is the global reinforcement which transmits to the plate and to the attachment screw the result of the forces to which it is subjected.

The traditional stresses transmitted to the binding screws are very low because a large portion of these stresses are neutralized in the reinforcement 31.

Furthermore, the rear support of pedal 24 on its plate 22 can be different. It can be formed by two distinct zones, which, as a result, would each be paired with one of tabs 36 and 37 to form the two rocking lines of the support plate.

Likewise, instead of the rear portion of the support plate 21 carried towards the bottom of the plate, the rear support could also be formed by a ear or a portion of axle engaged in an opening of the plate. The rear support could also be formed along two carrying zones of the same type of the front zones 34 and 35 of the plate and 36 and 37 of the plate.

The rear portion of the pedal 24 could likewise also rest on a shock absorption block which achieves vertical shock absorption, and which furthermore defines a moving carrying zone around which the pedal can oscillate.

Finally, although the invention has been described with reference to particular means, materials and embodiments, it is to be understood that the invention is not limited to the particulars disclosed and extends to all equivalents within the scope of the claim.

What is claimed is:

1. A retention element for retaining a boot on a gliding board, said retention element comprising:

a retention jaw adapted to maintain an end of the boot supported against the gliding board;

a body carrying said jaw, said body being adapted to be supported with respect to the gliding board;

a base plate carrying said body, said base plate being adapted to be affixed to the gliding board;

a spring carried by said body, said retention jaw being mounted to move in opposition to a return force exerted by said spring; and a compensation mechanism to lower said return force of said spring, said compensation mechanism comprising:

a support plate for supporting at least a portion of the boot, said support plate having a first support zone in constant support with respect to said base plate at a first longitudinal end of said support plate, said support plate further second support zone and two carrying zones at a second longitudinal end of said support plate, each of said two carrying zones being situated laterally on a respective side of said second support zone and being positioned for limited upward vertical movement by engagement with an abutment fixed with respect to said base plate upon lateral rocking of said support plate from a non-laterally rocked support position; wherein two lines of support about which said support plate is pivotal are defined by a respective one of said carrying zones at said second end of said support and said first support zone at said first end of said support plate;

an activation element having a portion mounted to have a vertical component of movement with respect to said base plate, said second support zone of said support plate resting upon said portion of said activation element; and a connection between said activation element and said jaw to transmit movement of said activation element to said jaw.

2. A retention element according to claim 1, wherein:

said lines of support converge.

3. A retention element according to claim 1, wherein:

each of said carrying zones of said support plate comprises a tab projecting from a remainder of said support plate; and said abutment fixed with respect to said base plate on either side of said second support zone of said support plate is defined by an opening through which a respective one of said tabs extends.

4. A retention element according to claim 3, wherein:

said second support zone of said support plate and said two carrying zones of said support plate are elastically supported by said activation element.

5. A retention element according to claim 1, wherein:

said second support zone of said support plate and said two carrying zones of said support plate are elastically supported by said activation element.

6. A retention element according to claim 1, wherein:

said first support zone at said first longitudinal end of said support plate consists of a single carrying zone by which said base plate carries said support plate.

7. A retention element according to claim 6, wherein:

said single carrying zone is formed by a longitudinally extending reinforcement rib projecting from one of said base plate and said support plate.

8. A retention element according 7, wherein:

said support plate comprises a pedal capped by a lining.

9. A retention element according to claim 8, wherein:

said lining comprises an anti-friction lining.

10. A retention element according 1, wherein:

said support plate comprises a pedal capped by a lining.

11. A retention element according to claim 10, wherein:

said lining comprises an anti-friction lining.

12. A retention element according to claim 7, wherein:

said base plate further comprises a reinforcement counterplate upon which said support plate rests; and said abutment on respective sides of said support zone of said support plate are surfaces of said reinforcement counterplate.

13. A retention element according to claim 12, wherein:

each of said carrying zones of said support plate comprises a tab projecting from a remainder of said support plate;

said reinforcement counterplate comprises, at a first longitudinal end, a pair of vertically extending ears; and said abutment fixed with respect to said base plate on either side of said second support zone of said support plate is defined by an opening in a respective one of said ears of said reinforcement counterplate through which a respective one of said tabs extends.

14. A retention element according to claim 1, wherein:

said retention jaw is adapted to maintaining a front end of the boot supported against the gliding board;

said first longitudinal end of said support plate comprises a front end; and said second longitudinal end of said support plate comprises a rear end.

* * * * *